US005528915A

United States Patent [19]

Percoco

[11] Patent Number: 5,528,915

[45] Date of Patent: Jun. 25, 1996

[54] LOCK ASSEMBLY

[75] Inventor: Stephen L. Percoco, Hull, Mass.

[73] Assignees: Jane M. Percoco; Ann M. Percoco, both of Hull, Mass.

[21] Appl. No.: 255,424

[22] Filed: Jun. 8, 1994

[51] Int. Cl.[6] ..... E05B 13/00

[52] U.S. Cl. ..... 70/416; 70/429; 292/359

[58] Field of Search ..... 70/1.5, 207, 209, 70/429, 430, 416; 292/288, 347, 358, 359, 169.14

[56] References Cited

U.S. PATENT DOCUMENTS

| | | | |
|---|---|---|---|
| 174,710 | 3/1876 | Taylor | 292/359 |
| 268,640 | 12/1882 | Dion | 70/429 |
| 377,815 | 2/1888 | Selleck et al. | 292/359 |
| 861,421 | 7/1907 | Young | 292/359 X |
| 956,947 | 5/1910 | Curlett | 292/359 |
| 2,463,195 | 7/1946 | Mungan | 70/416 |
| 2,515,364 | 7/1950 | Weaver | 292/359 |
| 2,540,686 | 2/1951 | Milburn | 292/359 X |
| 3,458,228 | 7/1969 | White | 292/359 |
| 3,862,556 | 1/1975 | Moses | 70/416 |
| 3,933,014 | 1/1976 | Moses | 70/416 |
| 4,189,176 | 2/1980 | Hamilton | 292/346 |
| 4,453,389 | 6/1984 | Kaufman | 70/416 |
| 4,861,084 | 8/1989 | Ozagir et al. | 292/359 |
| 4,887,856 | 12/1989 | Percoco et al. | 292/337 |
| 5,007,263 | 4/1991 | Taylor | 70/416 |
| 5,072,976 | 12/1991 | Meszaros | 292/359 X |
| 5,072,978 | 12/1991 | Woodward | 292/359 |

FOREIGN PATENT DOCUMENTS

| | | | |
|---|---|---|---|
| 496746 | 10/1953 | Canada | 292/359 |
| 2654766 | 5/1991 | France | 70/416 |
| 2377 | of 1905 | United Kingdom | 292/359 |
| 379466 | 9/1932 | United Kingdom | 292/359 |

*Primary Examiner*—Steven N. Meyers
*Assistant Examiner*—Suzanne L. Dino
*Attorney, Agent, or Firm*—Hamilton, Brook, Smith & Reynolds

[57] ABSTRACT

A lock assembly includes a retaining block having a substantially rectangular recess with a shoulder defining a transition between a wider outer portion and a narrow or inner portion. A door knob shaft having a rectangular cross-section extends through the inner portion of the recess in the retaining block for extending and retracting a striker. A substantially rectangular locking bar engageable with the recess has a shape which corresponds with the recess. The locking bar has a slot at one end for engaging and capturing the door knob shaft to prevent its rotation. When the orientation of the locking bar is reversed, the locking bar rests on the shoulder of the recess and does not engage the door knob shaft.

21 Claims, 3 Drawing Sheets

6
4
4
6
10
127
24
17
28
2
20
20a
127
4a
34
100
8
61
26
18
12
14
30
16
22
26
32
2a

LOCK ASSEMBLY

BACKGROUND

Locks for use in current-day residential structures generally include, inter alia, keyed cylinder locks, keyed deadbolt locks, slidebolts, chain locks, etc. Locks of these types are readily obtainable in hardware and building supply stores for installation in doors and door frames.

Often there are times when it is desirable for a door to be incapable of being unlocked from the outside. This is commonly accomplished by installing a separate secondary lock assembly such as a slide bolt on the door adjacent to the door knob/lock assembly. The slidebolt is manually locked from the inside and cannot be unlocked from the outside with a key. A drawback of installing a slidebolt is that the installation of a secondary lock assembly on the door and door frame can be unsightly. In order to improve appearances, a slide bolt can be incorporated within the door knob/lock assembly. Such a lock assembly is disclosed in U.S. Pat. No. 5,072,978. A drawback of this design is that the size, complexity and cost of the door knob/lock assembly is increased. Accordingly, there is a need for a simple door knob/lock assembly which, when desired, cannot be unlocked from the outside.

SUMMARY

The present invention resides in a lock assembly including a retaining block having a recess accessible from the outside of the block. The recess has an outer portion and an inner portion, the outer portion being wider than the inner portion. A rotatable shaft extends through the inner portion of the recess in the retaining block for extending and retracting a locking member. The shaft has two flat surfaces parallel to each other. A locking bar having first and second portions is engageable with the recess in the retaining block. The first portion of the bar is wider than the second portion. The second portion of the locking bar has a slot which is capable of straddling the two parallel flat surfaces of the shaft for capturing the shaft to prevent its rotation when the second portion of the locking bar is in the inner portion of the recess.

In preferred embodiments, the recess and the bar are substantially rectangular in shape. A shoulder in the recess of the retaining block defines the transition between the outer and inner portions. A shoulder on the bar defines the transition between the first and second portions. A door knob is affixed to the shaft for turning the shaft and the locking member is a striker. A striker plate is mounted to a door frame for capturing the striker. The locking bar is rotatable 180° such that when the bar is inserted into the recess, and so rotated, the second portion of the bar is prevented from entering the inner portion of the recess. As a result, the slot in the bar does not straddle the shaft to prevent its rotation. When the locking bar is in such an orientation, the lock assembly can be unlocked from the outside with a key.

The present invention provides a simple lock assembly which can be selectively locked from the inside such that, when desired, the lock assembly can be locked in a manner in which the lock assembly cannot be unlocked from the outside with a key.

BRIEF DESCRIPTION OF THE DRAWINGS

The foregoing and other objects, features and advantages of the invention will be apparent from the following more particular description of preferred embodiments of the drawings in which like reference characters refer to the same parts throughout the different views. The drawings are not necessarily to scale, emphasis instead being placed upon illustrating the principles of the invention.

DETAILED DESCRIPTION OF THE PREFERRED EMBODIMENTS

Figure 1:
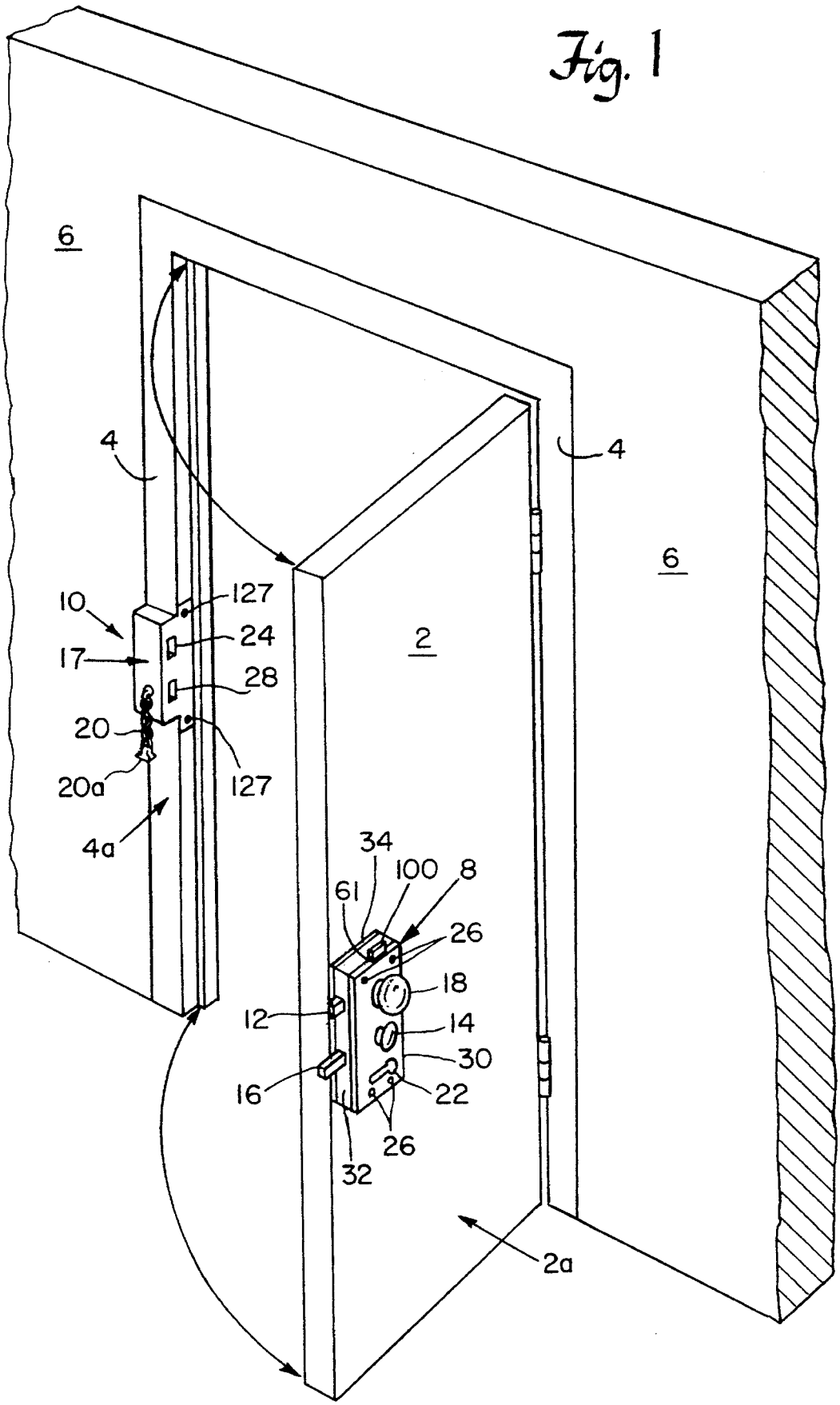
FIG. 1 is a perspective view of a door in an open position with the present invention lock assembly and striker plate assembly mounted to a door and door frame respectively.

Referring to FIG. 1, the present invention lock system consists of a lock mounting assembly 8 and a striker plate assembly 10. Lock mounting assembly 8 is mounted on the interior surface 2*a* of door 2 by screws 26. Lock mounting assembly 8 includes a core block 32 sandwiched between two cover plates or retaining blocks, an outer cover plate 30 and an inner cover plate 34. Core block 32 houses a striker 12 and a deadbolt 16. Striker 12 is activated by door knob 18 to provide a first locking means. Deadbolt 16 is activated by knob 14 to provide a second locking means. A chain lock slot 22 is formed within outer cover plate 30 below knob 14. Chain lock slot 22 engages with chain lock 20 to provide a third locking means.

Striker plate assembly 10 includes a striker plate 17 which is mounted to door frame 4 within wall 6 by screws 127. Striker 12 engages recess 24 and deadbolt 16 engages recess 28 within striker plate 17. Striker plate 17 is configured so that recesses 24 and 28 are offset from door frame 4 in order to accept and capture striker 12 and deadbolt 16. Chain lock 20 is affixed to striker plate 17. Head 20*a* on chain lock 20 engages chain lock slot 22 on lock mounting assembly 8.

The deadbolt 16 and the striker 12 can be locked and unlocked from the outside with a key. Alternatively, lock mounting assembly 8 can be made such that only the deadbolt 16 or only the striker 12 can be unlocked from the outside with a key.

A locking bar 100 is capable of being inserted into locking recess 61 of lock mounting assembly 8 in an orientation which prevents the rotation of door knob 18 and the retraction of striker 12. As a result, the lock mounting assembly 8 can be effectively locked from the inside to prevent the lock mounting assembly 8 from being opened from the outside even with the key. If the locking bar 100 is removed from recess 61 and re-inserted into recess 61 in an orientation 180° from the locking orientation, the rotation of door knob 18 is not prevented so that lock mounting assembly 8 can be unlocked from the outside. A more detailed discussion of locking bar 100 is given below.

Figure 2:
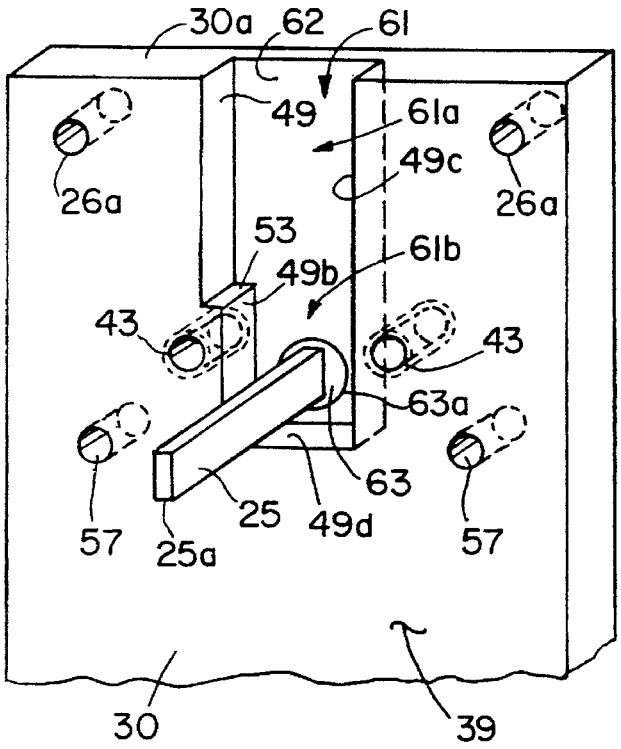
FIG. 2 is a perspective view of the back of the upper portion of the outer cover plate showing the door knob shaft and locking recess.
Figure 4:
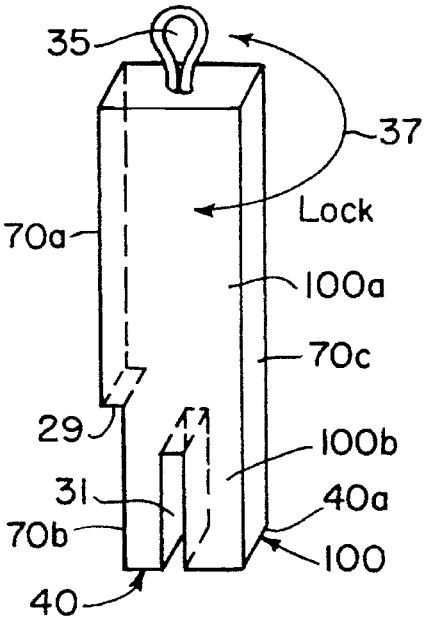
FIG. 4 is a perspective view of the locking bar.
Figure 3:
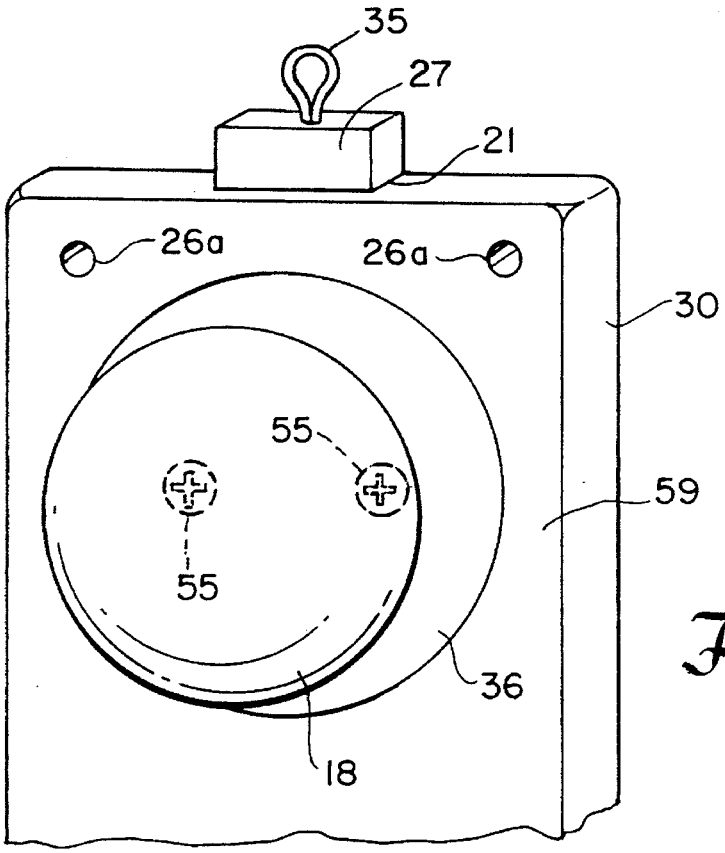
FIG. 3 is a perspective view of the front of the upper portion of the outer cover plate showing the door knob.

Referring to FIGS. 2, 3 and 4, outer cover plate 30 has a locking recess 61 beginning from end 30*a* and extending partway along the back surface 39 of outer cover plate 30. Recess 61 as initially formed, is a stepped slot which is open through surface 39 and end 30*a* of outer cover plate 30. When outer cover plate 30 is fastened to core block 32, surface 39 abuts against core block 32 such that recess 61 is open only at end 30*a*. Recess 61 has an outer portion 61*a* and an inner portion 61*b*. The perimeter of recess 61 is defined by surfaces 49*a*, 49*b*, 49*c*, 49*d* and shoulder 53. Shoulder 53 provides the transition between the outer portion 61*a* and the inner portion 61*b*. The outer portion 61*a* is wider than the inner portion 61*b*. A circular hole 63*a* is located within the inner portion 61*b* of recess 61.

Door knob shaft 25 is fixed to door knob 18 and has a portion 25*a* with a rectangular cross-section and a portion 63 with a circular cross-section. Circular portion 63 is retained within circular hole 63*a* so that door knob shaft 25 intersects and passes through recess 61 at the inner portion 61*b* in a direction lateral to surface 62 of recess 61. Although portion 25*a* is preferably rectangular in cross-section, alternatively, portion 25*a* can be of other polygonal shapes having two parallel sides such as hexagonal.

Holes 26*a* mate with corresponding holes in core block 32 and inner cover plate 34 to allow lock mounting assembly 8 to be fastened to door 2 by screws 26 (FIG. 1). Holes 57 allow outer cover plate 30, core block 32 and inner cover plate 34 to be bolted together as an assembly before being fastened to door 2. Threaded holes 43 allow door knob cover plate 36 to be affixed to the front surface 59 of outer cover plate 30 with screws 55.

The locking bar 100 is substantially rectangular having a shape corresponding to recess 61. Locking bar 100 has a first portion 100*a* and a second portion 100*b*. The first portion 100*a* is wider than the second portion 100*b*. Shoulder 29 separates and provides the transition between the first portion 100*a* and the second portion 100*b*. A slot 31 in the second portion 100*b* of locking bar 100 extending from the bottom surface 40 is dimensioned to engage rectangular portion 25*a* of door knob shaft 25. A loop 35 extending from locking bar 100 provides a handle for grasping locking bar 100. A cord or chain can be fastened to loop 35 and affixed to lock mounting assembly 8 so that locking bar 100 cannot be lost.

When it is desirable for lock mounting assembly 8 to be incapable of being unlocked from the outside, locking bar 100 is inserted into recess 61 of outer cover plate 30 in an orientation such that the second portion 100*b* of locking bar 100 slides into inner portion 61*b* of recess 61 and shoulder 29 of locking bar 100 rests upon shoulder 53 of recess 61. In such an orientation, surfaces 70*a*, 70*b*, 70*c* and shoulder 29 of locking bar 100 mate with respective surfaces 49*a*, 49*b*, 49*c* and shoulder 53 of recess 61. Bottom surface 40 of locking bar 100 is preferably above surface 49*d* of recess 61, but alternatively, bottom surface 40 can rest upon surface 49*d*. Slot 31 engages the rectangular portion 25*a* of door knob shaft 25 which captures and prevents the rotation of door knob shaft 25 and door knob 18. This prevents striker 12 (FIG. 1) from being retracted and, therefore, the lock mounting assembly 8 cannot be unlocked from the outside even with a key.

When it is desirable for lock mounting assembly 8 to be unlocked from the outside, the locking bar 100 is removed from recess 61 and reinserted into recess 61 with the orientation of locking bar 100 reversed 180° as depicted by arrows 37. In such an orientation, surface 70*c* of locking bar 100 mates with surface 49*a* of recess 61 and surface 70*a* of locking bar 100 mates with surface 49*c* of recess 61. Portion 40*a* of the bottom surface 40 of locking bar 100 rests upon shoulder 53 of recess 61 preventing the second portion 100*b* of locking bar 100 from sliding into the inner portion 61*b* of recess 61. As a result, slot 31 does not engage door knob shaft 25 and shaft 25 is free to rotate. Therefore, lock mounting assembly 8 can be unlocked from the outside with a key. Alternatively, locking bar 100 can be orientated such that if the dimensions of locking bar 100 permit, shoulder 29 of locking bar 100 rests upon end 30*a* while the bottom 40 of locking bar 100 partially engages the inner portion 61*b* of recess 61 above shaft 25. Additionally, locking bar 100 does not need to be reinserted into recess 61.

The components of the striker plate assembly 10 and the exterior components of lock mounting assembly 8 are preferably made of brass plated steel while the interior components of lock mounting assembly are preferably made of steel. Alternatively, the components of striker plate assembly 10 and lock mounting assembly 8 do not have to be brass plated. Additionally, the components of lock mounting assembly 8 and striker plate assembly 8 can be made from other suitable metals such as cast iron or solid brass.

Figure 5:
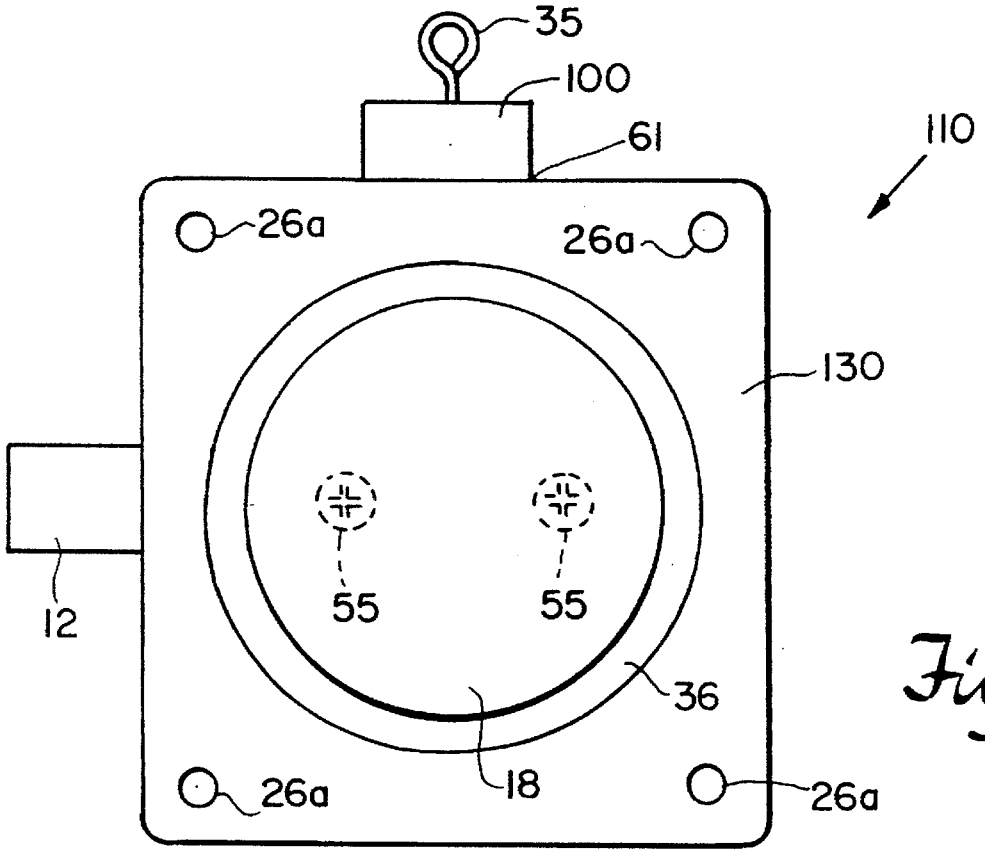
FIG. 5 is a front view of an individual door knob assembly having a locking bar.

Referring to FIG. 5, door knob assembly 110 is an individual door knob mechanism which differs from lock mounting assembly 8 in that door knob assembly 110 does not include a deadbolt or a chain lock. Locking bar 100 is inserted into recess 61 within outer cover plate 130 to prevent the rotation of door knob 18 in the same manner as described above regarding lock mounting assembly 8.

Figure 6:
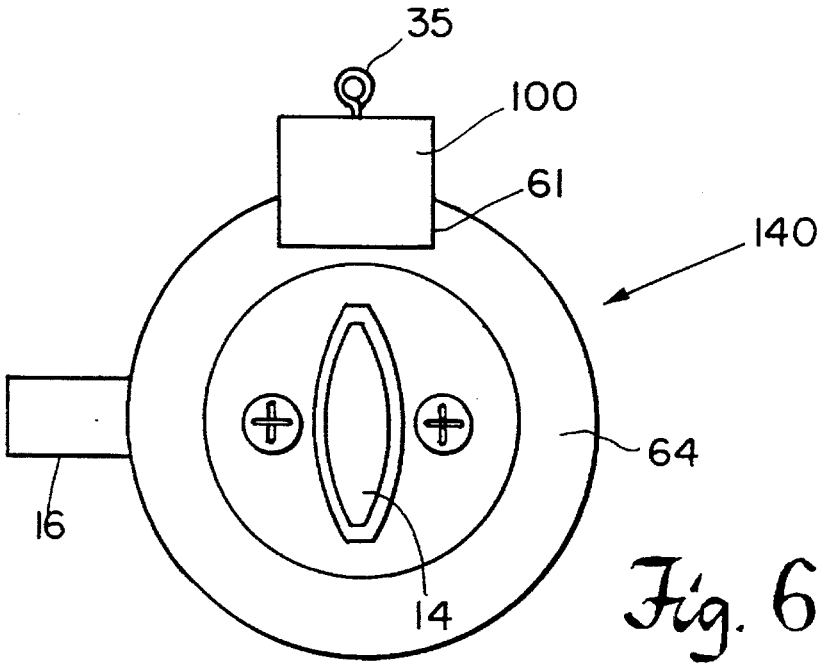
FIG. 6 is a front view of an individual deadbolt assembly having a locking bar.

Referring to FIG. 6, deadbolt assembly 140 is an individual deadbolt mechanism which can be locked on the inside by inserting locking bar 100 into recess 61 within outer cover plate 64. Knob 14 is affixed to a shaft similar to shaft 25 depicted in FIG. 2 and the rotation of knob 14 is prevented by locking bar 100 in a manner similar to that depicted in FIGS. 2–4 and described above. Deadbolt assembly 140 can be installed on a door to supplement an existing door knob assembly.

Equivalents

While this invention has been particularly shown and described with references to preferred embodiments thereof, it will be understood by those skilled in the art that various changes in form and details may be made therein without departing from the spirit and scope of the invention as defined by the appended claims.

Although the lock mounting assembly 8 has been depicted to be affixed to surface 2*a* of door 2, lock mounting assembly 8 can be affixed within a recess in door 2. In such a case, striker plate 17 would be configured accordingly to accept striker 12 and deadbolt 16. Additionally, although locking bar 100 is depicted to be inserted vertically into recess 61, recess 61 can be horizontal or at an angle. Furthermore, although recess 61 is shown to have only a single shoulder 53 on one side of recess 61, recess 61 can alternatively have a shoulder on two sides. In such a case, the corresponding locking bar would be inserted upside down within recess 61 if rotation of door knob shaft 25 is desired. Also, although the figures depict employing locking bar 100 for preventing the rotation of shaft 25 and door knob 18, locking bar 100 can be employed for preventing the rotation of knob 14 and deadbolt 16.

What is claimed is:

1. A lock assembly comprising:

a retaining block, a recess in the retaining block accessible from the outside of the retaining block, the recess having an outer portion and an inner portion, the outer portion being wider than the inner portion;

a rotatable shaft extending through the inner portion of the recess for extending and retracting a locking member, the shaft having two flat surfaces parallel to each other;

a locking bar engageable within the recess, the locking bar having first and second portions, the first portion of the locking bar being wider than the second portion;

a slot in the second portion of the locking bar for straddling the two parallel flat surfaces of the shaft for capturing the shaft and preventing its rotation when the second portion of the locking bar is in the inner portion of the recess; and the locking bar being rotatable 180° such that when the locking bar is inserted into the recess and so rotated, the second portion of the locking bar is prevented from entering the inner portion of the recess such that the slot in the locking bar does not straddle the shaft to prevent its rotation.

2. The lock assembly of claim 1 in which a door knob is affixed to the shaft and the locking member is a striker.

3. The lock assembly of claim 2 further comprising a striker plate mounted to a door frame for capturing the striker.

4. The lock assembly of claim 2 further comprising a dead bolt mechanism proximate to the door knob.

5. The lock assembly of claim 2 in which the retaining block is a cover plate, the lock assembly further comprising a core retaining block adjacent to the cover plate for housing the striker.

6. The lock assembly of claim 3 further comprising a chain lock.

7. The lock assembly of claim 1 in which a shoulder in the recess of the retaining block defines the transition between the outer and inner portions, and a shoulder on the locking bar defines the transition between the first and second portions.

8. The lock assembly of claim 1 in which the recess and the locking bar are substantially rectangular in shape.

9. A lock assembly comprising:

a retaining block, a recess in the retaining block accessible through an outside surface of the retaining block, the recess having an outer portion and an inner portion, the outer portion being wider than the inner portion, a shoulder in the recess defining the transition between the outer and inner portions;

a rotatable shaft extending through the inner portion of the recess for extending and retracting a locking member, the shaft having two flat surfaces parallel to each other;

a locking bar engageable within the recess, the locking bar having a central axis and a bottom, the locking bar having first and second portions, the first portion of the locking bar being wider than the second portion, a shoulder on the locking bar defining the transition between the first and second portions; and a slot in the second portion of the locking bar for straddling the two parallel flat surfaces of the shaft for capturing the shaft and preventing its rotation when the second portion of the locking bar is in the inner portion of the recess, the locking bar being rotatable 180° about its central axis such that when the locking bar is inserted into the recess and so rotated, the shoulder on the locking bar engages the outside surface of the retaining block, thereby preventing the second portion of the locking bar from entering the inner portion of the recess such that the slot in the locking bar does not straddle the shaft to prevent its rotation.

10. The lock assembly of claim 9 in which a door knob is affixed to the shaft and the locking member is a striker.

11. The lock assembly of claim 10 further comprising a striker plate mounted to a door frame for capturing the striker.

12. The lock assembly of claim 10 further comprising a dead bolt mechanism proximate to the door knob.

13. The lock assembly of claim 10 in which the retaining block is a cover plate, the lock assembly further comprising a core retaining block adjacent to the cover plate for housing the striker.

14. The lock assembly of claim 11 further comprising a chain lock.

15. The lock assembly of claim 9 in which the recess and the locking bar are substantially rectangular in shape.

16. A lock assembly comprising:

a retaining block, a substantially rectangular recess in the retaining block accessible through an outside surface of the retaining block, the recess having an outer portion and an inner portion, the outer portion being wider than the inner portion, a shoulder in the recess defining the transition between the outer and inner portions;

a rotatable shaft extending through the inner portion of the recess for extending and retracting a striker, the shaft having two flat surfaces parallel to each other;

a substantially rectangular locking bar engageable within the recess, the locking bar having a central axis and a bottom, the locking bar having first and second portions, the first portion of the locking bar being wider than the second portion, a shoulder on the locking bar defining the transition between the first and second portions, the locking bar being capable of engaging the recess in an orientation such that the shoulder of the locking bar is adjacent to the shoulder of the recess; and a slot in the second portion of the locking bar for straddling the two parallel flat surfaces of the shaft for capturing the shaft and preventing its rotation when the second portion of the locking bar is in the inner portion of the recess, the locking bar being rotatable 180° about its central axis such that when the locking bar is inserted into the recess and so rotated, the bottom of the locking bar rests upon the shoulder of the recess, thereby preventing the second portion of the locking bar from entering the inner portion of the recess such that the slot in the locking bar does not straddle the shaft to prevent its rotation.

17. The lock assembly of claim 16 further comprising a striker plate mounted to a door frame for capturing the striker.

18. The lock assembly of claim 17 further comprising a chain lock.

19. The lock assembly of claim 16 further comprising a dead bolt mechanism proximate to the door knob.

20. The lock assembly of claim 16 in which the retaining block is a cover plate, the lock assembly further comprising a core block adjacent to the cover plate for housing the striker.

21. A method of locking a door comprising the steps of:

providing a retaining block having a recess, the recess having an outer portion and an inner portion, the outer portion being wider than the inner portion;

extending a rotatable shaft through the inner portion of the recess in the retaining block for extending and retracting a locking member, the shaft having two flat surfaces parallel to each other;

inserting a locking bar into the recess in the retaining block, the locking bar having first and second portions, the first portion of the locking bar being wider than the second portion, the second portion of the locking bar engaging the inner portion of the recess, a slot in the second portion of the locking bar straddling the two parallel flat surfaces of the shaft for capturing the shaft and preventing its rotation; and the locking bar being rotatable 180° such that when the locking bar being inserted into the recess and so rotated, the second portion of the locking bar is prevented from entering the inner portion of the recess such that the slot in the locking bar does not straddle the shaft to prevent its rotation.

* * * * *